US005408715A

United States Patent [19]

Keller et al.

[11] Patent Number: 5,408,715

[45] Date of Patent: Apr. 25, 1995

[54] METHOD AND SYSTEM FOR THE TREATMENT OF WEBS OF TEXTILE MATERIAL BY LIQUIDS AND STEAM

[75] Inventors: Alfred Keller, Willich; Julius Kohnen, Tönisvorst, both of Germany

[73] Assignee: Eduard Küsters Maschinenfabrik GmbH & Co. KG, Krefeld, Germany

[21] Appl. No.: 182,878

[22] Filed: Jan. 13, 1994

[30] Foreign Application Priority Data

Jan. 18, 1993 [DE] Germany ..... 9300554 U

[51] Int. Cl.[6] ..... D06B 3/12; D06B 3/22; D06B 23/24

[52] U.S. Cl. ..... 8/149.1; 68/5 D

[58] Field of Search ..... 8/149.1; 68/5 D, 5 E

[56] References Cited

U.S. PATENT DOCUMENTS 3,124,429 3/1964 Alexeff et al. ..... 68/5 D X
3,609,781 10/1971 Dunderdale ..... 68/5 D X
3,651,671 3/1972 Sando et al. ..... 68/5 E

FOREIGN PATENT DOCUMENTS 2716264 10/1978 Germany .
2426480 12/1984 Germany .
3835549 4/1990 Germany .
1-48868 6/1989 Japan ..... 68/5 D

*Primary Examiner*—Philip R. Coe
*Attorney, Agent, or Firm*—Kenyon & Kenyon

[57] ABSTRACT

In a steamer for the steaming of a web of textile material laden with liquid supplied by an applicator device, steam is continuously fed to the steamer. The quantity of steam fed to the steamer is calculated in dependence upon the amount of liquid previously applied to the web and accurately corresponds to the amount of steam necessary in order to heat the web of material to the steaming temperature.

15 Claims, 2 Drawing Sheets

METHOD AND SYSTEM FOR THE TREATMENT OF WEBS OF TEXTILE MATERIAL BY LIQUIDS AND STEAM

BACKGROUND OF THE INVENTION

The present invention relates generally to improvements in techniques for regulating the feed of steam to a steamer. Such devices are used with respect to the treatment by liquid and steam of continuously passing webs of material, and are frequently used in textile finishing.

If the web material arrives at the steamer after continuous passage through several treatment stations, it will have a total moisture content that is the sum of a number of prior steps that have added moisture to the web. For example, these prior steps can include, the residual moisture remaining after prewashing (after squeezing) and of the amount of moisture added from different impregnation and dyeing or printing processes in each of the subsequent stations. Regardless of the origin of the moisture, the material web must be brought to the steamer temperature with this total load of web moisture. The amount of heat necessary to accomplish this is supplied by the steam introduced into the steamer.

From Federal Republic of Germany Patent 27 16 264, a steamer is known which has downwardly open shafts on the steamer housing for the introduction and removal of the web of material. Within the shafts, a boundary layer is formed between the steam atmosphere prevailing in the steamer housing and the outer air. The position of this boundary layer is determined by means of temperature sensors arranged in the vertical shafts, the signal of which sensors serves to control the feeding of steam into the steamer housing. In this way it is possible to keep the steamer filled with steam without certain amounts of steam continuously flowing off over the lower edge of the vertical shafts and being lost. The amount of steam added can rather be so regulated that the boundary layer remains somewhere in the height of the vertical shafts but does not advance to its lower edge.

The control of the feeding of steam in this manner has the disadvantage of considerable inertia, leading to low starting-up processes until steady conditions are reached. There remains a need for the further development of a method and a system for the treatment of webs of textile material by liquid and steam through which steady-state conditions are established more rapidly.

SUMMARY OF THE INVENTION

The present invention addresses this need by providing a method and apparatus for better regulating the feed of steam to a steamer that is continuously fed with webs of material that have previously been subjected to treatment by liquids. In this system, a proportional amount of steam is calculated in dependence upon the amount of liquid previously applied to the web of material. The steam is continuously fed to the steamer, and is thus provided in an amount sufficient to provide the heat necessary in order to heat the web of material which is laden with liquid to the desired steaming temperature.

The liquid treatments to which the web is typically subjected prior to entering the steamer may include washing baths, wetting-agent and other chemical baths, and treatments with aqueous liquids (e.g., dye baths).

Given the high thermal capacity of water, the amount of steam that is required in order to bring a web of material that is laden with moisture from such aqueous treatments to the desired steaming temperature is dependent very predominantly on the amount of liquid applied, which thus forms the best basis for the calculation and feeding of the required amount of steam.

Because in the present invention the amount of steam which has been calculated as necessary in order to heat the amount of liquid applied is fed to the steamer housing, any overshooting by the initial introduction of too large or too small an amount of steam is avoided, and the steady state is reached substantially faster.

Another feature of this invention provides for continuously feeding to the steamer housing a small excess amount of steam in addition to the calculated quantity of steam, so as to assure the continuous filling of the steamer housing with steam and to form a buffer for variations in the need for steam due to different properties of the web of material.

The feeding of the calculated amount of steam along with any of the excess amount, if any, should take place only after the steamer housing has already been entirely filled with steam. This can be determined by suitable means which then trigger the feeding of the calculated quantity of steam.

So as to provide a measure of the amount of treatment liquid which has been applied to the web, the output of the corresponding metering pump which meters the treatment liquid out to the corresponding applicator device is monitored in one embodiment. This output can easily be represented as an electrical value or signal which can then be used for controlling the feed of steam.

Where the applicator devices each transfer a metered, measurable quantity of liquid to the web of material, the total amount of liquid applied can be determined by simply monitoring the metered amounts. However, there are circumstances in which this is not possible, e.g., when a padding machine is used. In such cases, the total amount of aqueous liquid applied (which is used to determine the amount of steam that is required) is directly determined by a moisture measuring instrument arranged in front of the entrance into the steamer that provides a measure of the quantity of moisture on the web at that location.

In general, the system employs a downward-directed opening of the steamer housing located in the region of the bottom of the steamer housing. Associated with this opening is an overflow edge formed above the bottom of the steamer housing.

Any excess steam discharges at the overflow edge through an overflow opening into a vertical flow channel located on the outside of the steamer housing.

The determination that the steamer housing is full and the transfer to automatic feeding of the calculated amount of steam can be effected by employing a temperature sensor arranged in the discharge region of the excess steam. The temperature sensor is connected to a control device that uses this information to govern the position of the control valve.

BRIEF DESCRIPTION OF THE DRAWINGS

For a more complete understanding of this invention, reference should be made to the embodiments illustrated in greater detail in the accompanying drawings and described below. In the drawings.

DETAILED DESCRIPTION

Figure 1:
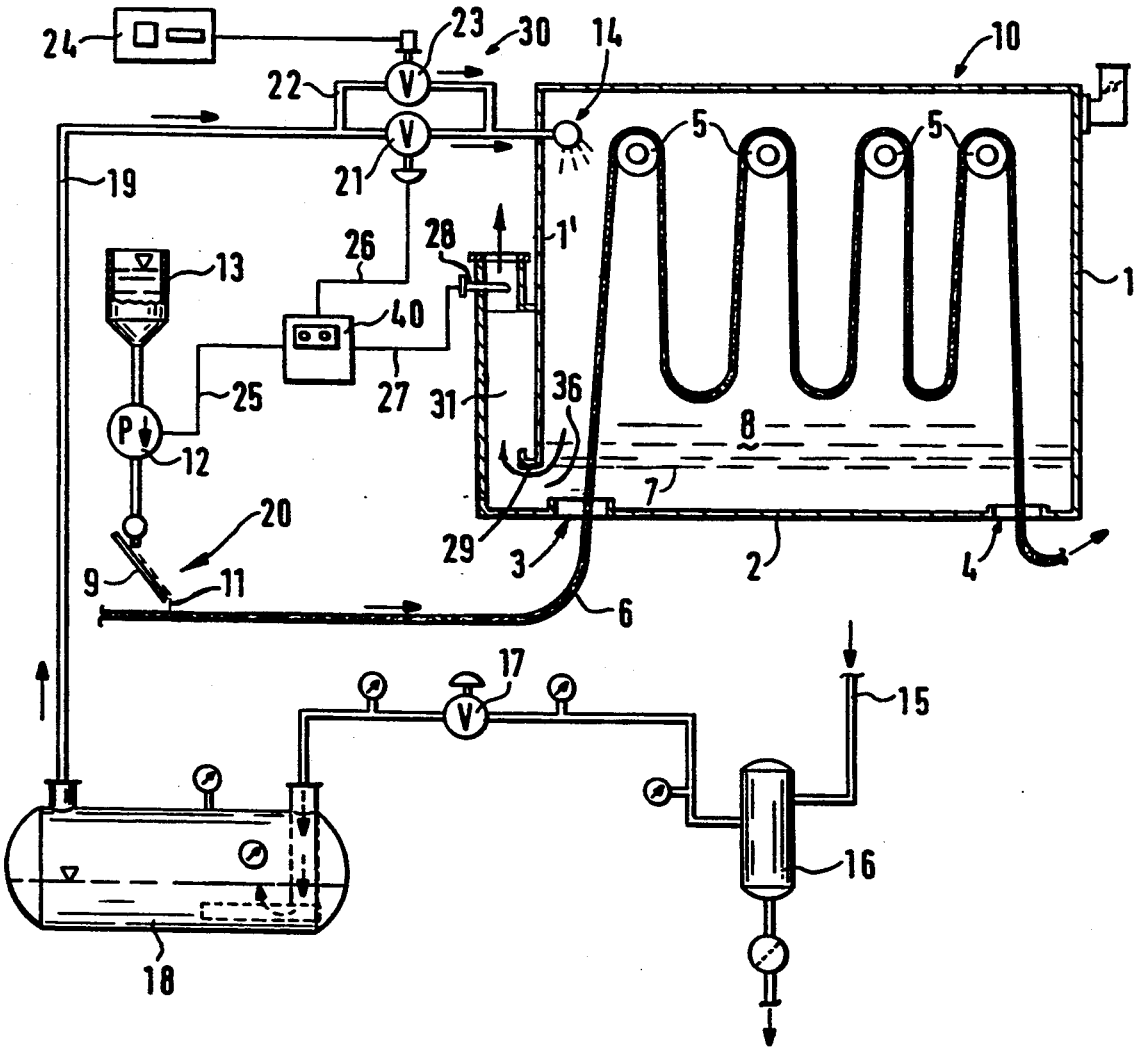
FIG. 1 schematically illustrates a first embodiment of a system constructed according to the principles of the invention that provides control over the feeding of steam.

In accordance with FIG. 1, the steamer 10 comprises a block-shaped steamer housing having a bottom 2 within which an inlet opening 3 and an outlet opening 4 are developed. The left vertical wall 1' of the housing terminates at a slight distance above the bottom 2, so that an overflow edge 29 is formed which determines the position of the lower limit 7 of the steam atmosphere 8 present in the housing 1 and over which excess steam flows into the vertical flow channel 31 formed on the outside of the wall 1'. Between the bottom 2 and the overflow edge 29, there is thus formed an overflow opening 36 from which steam can emerge from the steamer housing 1.

In the upper region of the steamer housing 1, guide rolls 5, arranged in a horizontal plane, are provided, over which the continuously advancing web of material 6 is guided in hanging loops.

In front of the entrance into the steamer housing 1, the web of material 6, which is supported by suitable guide means (not shown), passes through an applicator device 20 which applies a treatment liquid, for instance an aqueous dye bath, uniformly over the width of the web of material 6. A metering pump 12 removes the liquid from a storage container 13 and delivers it to a doctor-like run-off surface 9, which is inclined obliquely downward towards the web of material 6, from the lower edge of which surface the liquid drops onto the web of material 6 in a uniform veil 11 over the width of the web of material 6. The web of material 6 receives a precise predetermined amount of liquid per unit of area.

The web of material 6 thus laden with liquid travels through the entrance opening 3 into the steamer housing 1 where it is heated and allowed to stay at elevated temperature for a predetermined period of time, which is dependent on the speed of advance of the web of material 6 and the content of the steamer.

The steam is fed to the steamer housing 1 through a nozzle arrangement 14. The steam is generated at a steam boiler and is fed via a water separator 16 and a pressure-regulating valve 17 to a saturator 18 from whence saturated steam passes via the line 19 to the nozzle arrangement 14. Within the line 19, there is provided a valve arrangement, designated generally as 30, which comprises a quantity control valve 21 by which the amount of steam fed to the nozzle arrangement 14 can be controlled as a function of a corresponding electric control signal.

The quantity control valve 21 is bridged over by a by-pass line 22 in which there is arranged a control valve 23 which, in its turn, can be actuated by a control unit 24. By means of the control unit 24, the valve 23 can be opened to the desired degree or closed entirely.

The quantity control valve 21 is connected via a line 26 to a central control device 40. Also connected to the central control device is a line 25, which conducts a signal proportional to the output of the pump 12. Furthermore, an additional line 27 conducts a signal provided by a temperature sensor 28 to the control device 40. The temperature sensor 28 is arranged in the region of discharge of the excess steam emerging over the overflow edge 29 at the upper end of the flow channel 31, which shields it from external influences and extends over a substantial part—about one half in the embodiment shown—of the height of the housing 1. The temperature sensor 28 is therefore arranged at a clear distance above the steam limit 7.

When plant operation commences, the quantity control valve 21 remains in its initially closed state. The control valve 23 is opened via a command from the control unit 24 so that steam commences to flow from the line 19 into the steamer housing 1 via the nozzle arrangement 14. Since the steam is less dense than air, the steamer housing is filled with steam from the top down until the steam emerges at the overflow edge 29. Since this is located slightly higher than the openings 3 and 4, the emergence of the steam occurs only at the overflow edge 29. The steam discharges over the overflow edge 29 in the direction indicated by the arrow and passes through the flow channel 31. The temperature sensor 28 located within the flow channel determines a temperature which has been increased by the steam and provides a corresponding signal via the line 27 to the control unit 40, which recognizes that the steamer housing 1 has been filled with steam. Transfer then takes place to automatic control of the amount of steam. A signal representing the amount of liquid which has been applied to the web of material 6 passes, via the line 25, to the control unit 40, which, in turn generates a signal to the quantity control valve 21. As a result, the quantity control valve 21 opens by an amount which is proportional to the output of the pump 12 and thus to the amount of liquid applied in the applicator device 20. The appropriate proportionality factor is computed by reference to the relevant heat values. The amount of steam fed via the quantity control valve 21 to the steamer housing 1 should, if possible, precisely cover the heat requirement in order to heat the web of material 6 laden with the liquid to the desired steaming temperature. This heat requirement is determined very predominantly by the heat required in order to heat the applied amount of liquid to the steaming temperature. Under ideal conditions, in which the precisely calculated amount of steam is supplied via the nozzle arrangement 14, the steamer housing 1 does not become empty and none of the steam supplied via the quantity control valve 21 passes out at the entrance opening 3. The steam fed via the quantity control valve 21 is precisely consumed. In order, however, to have a certain safety factor, the control valve 23, which initially had only the function of filling the steamer housing 1 with steam, continues to remain somewhat open and feeds, in addition to the calculated amount of steam which the quantity control valve 21 supplies, also a small excess amount of steam which continuously discharges at the overflow edge 29.

Figure 2:
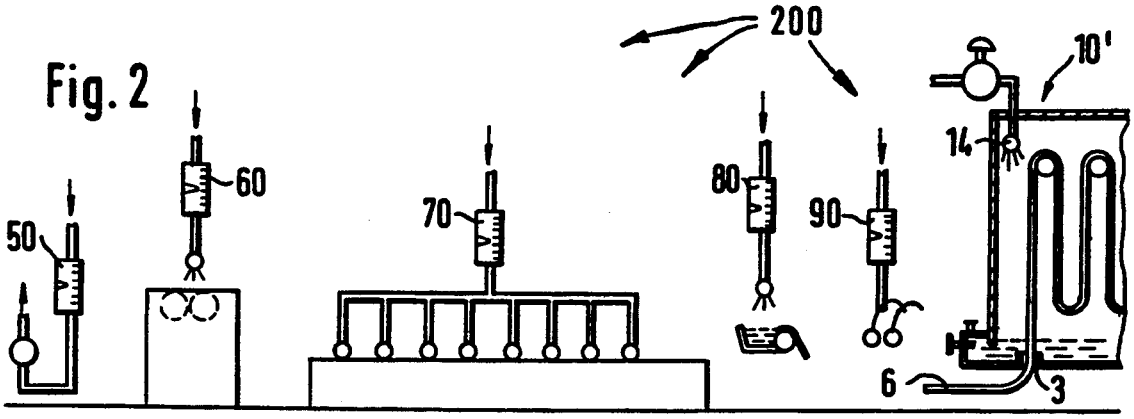
FIG. 2 is a schematic view of additional components of a system for the liquid and steam treatment of webs of textile material.

The system shown in FIG. 2 and designated generally as 200, comprises five stations with applicator devices 50, 60, 70, 80, 90 which have been shown only symbolically and which apply aqueous treatment liquids to the web of textile material (not shown) in this region.

In the applicator 50, a prewashing takes place followed by squeezing to a given residual moisture. In the padder 60, different chemicals are applied (possibly to provide color), squeezing to a higher residual moisture again taking place. Further liquid is added in the form of printing pastes in the screen printing machine 70. After the printing, a layer of gum is applied in the applicator 80, which can be followed again by a dyeing liquid in the applicator 90. Any number or arrangement of the applicator devices 50, 60, 70, 80 and 90 may be employed with the invention. Whatever the number or arrangement of applicators, by the time the web has reached the steamer 10' shown at the right of FIG. 2, a particular quantity of liquid has been laid down on each unit length of web. An alternative method of metering the steam required to contend with this quantity of liquid is set forth in a second embodiment for the steamer 10' in FIG. 3, in which functionally equivalent parts have been provided with the same reference numbers.

Figure 3:
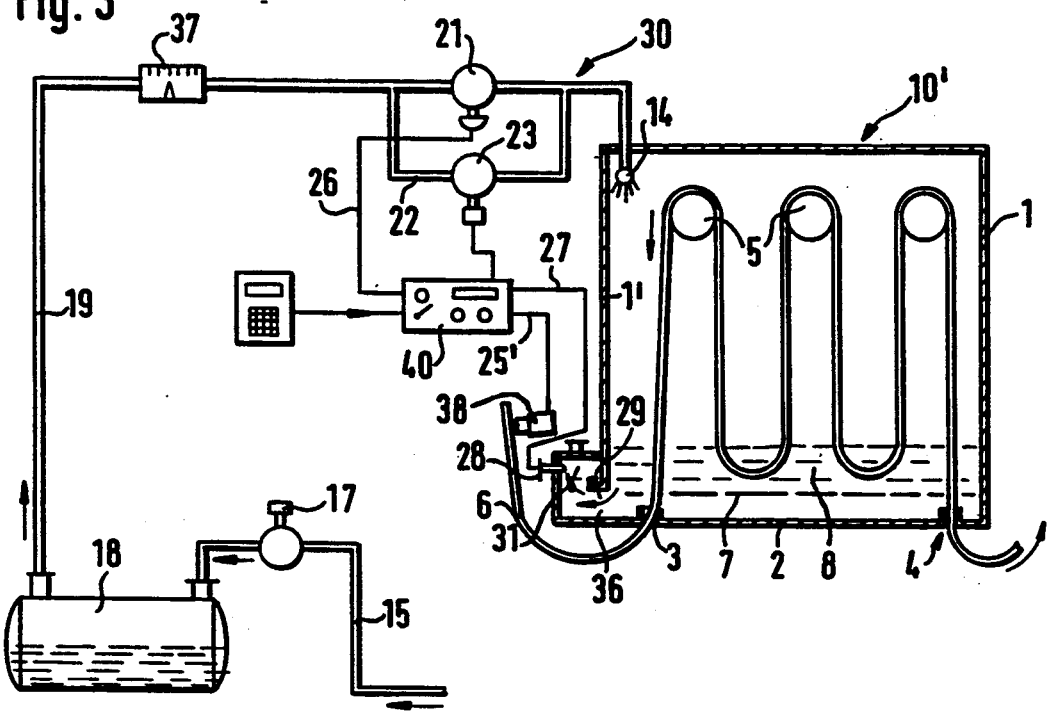
FIG. 3 schematically illustrates a second embodiment of a control system for the feeding of the steam.

A primary difference from the embodiment shown in FIG. 1 is that the applicator device 20 in the former embodiment applies the treatment liquid in metered quantity so that its rate of flow can be a measure of the quantity of liquid constituting the treatment of the web of material 6. In the embodiment of FIG. 3, on the other hand, the web of material 6, which is supported by suitable guide means (not shown), before entering into the steamer housing 1, passes through the applicator device 50, 60, 70, 80, 90, which apply aqueous treatment liquids uniformly over the width of the web of material, but not necessarily in metered amounts. The amount of treatment liquid applied per unit area of the web of material 6 need not be determined exactly but can differ, depending on the structure of the web of material 6 or other circumstances. The determination of the amount applied to the web must, therefore, be made in a different manner, i.e., by a direct measurement of this quantity on the web itself.

The web of material 6 laden with liquid passes through the entrance opening 3, as in FIG. 1, into the steamer housing 1, and is heated there and left there at elevated temperature for a predetermined period of time, in dependence upon the speed of advance of the web of material 6 and the steamer capacity. The steam is fed to the steamer housing 1 through a nozzle arrangement 14.

The steam passes via a line 15 from a steam boiler and is fed via a pressure regulating valve 17 to a saturator 18 from where saturated steam passes via the line 19 to the nozzle arrangement 14. Within the line 19, there are provided a steam flow quantity meter 37 and a valve arrangement, designated generally as 30, which comprises a quantity control valve 21 by which the quantity of the steam being fed to the nozzle arrangement 14 can be controlled as a function of a corresponding electric control signal.

The quantity control valve 21 is bridged over by a bypass line 22 in which a control valve 23 is arranged, and it is connected via a line 26 to a central control device 40 at which a signal coming from a high-moisture measuring instrument 38 also arrives via a line 25'. The moisture measuring instrument 38 may, for example, employ microwaves to this end and have a plurality of measurement heads mounted in fixed position over the width of the web of material 6, or it may use a single measurement head which traverses over the web of material 6 in transverse direction. Furthermore, there is connected to the control device 40, via a line 27, a temperature sensor 28 which is arranged in the region of discharge of the excess steam emerging over the overflow edge 29 at the upper end of the flow channel 31, which protects against external influences. The temperature sensor 28 is arranged at a clear distance above the steam limit 7.

The initial operation of the embodiment is effected in the same manner as in the embodiment of FIG. 1. After transfer to automatic control of the amount of steam, a signal representing the amount of liquid which has been applied to the web of material 6 (measured by means of the high-moisture measuring instrument 38) passes to the control unit 40 which, in its turn, provides a signal to the quantity control valve 21 such that the quantity control valve 21 opens by an amount which is proportional to the total amount of liquid applied in the applicator devices 50 through 90.

Figure 4:
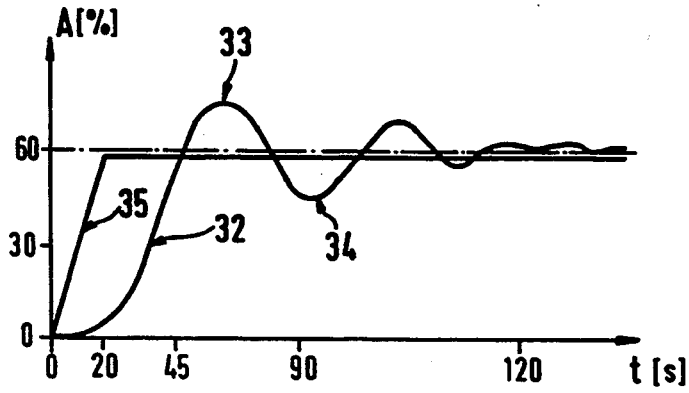
FIG. 4 is a graph comparing the degree of opening of the quantity control valve versus time for both an embodiment of the instant invention and a prior art device.

In FIG. 4, the degree A of opening in per cent of the quantity control valve 21 is plotted over time t in seconds. The curve 32 shows the behavior in the case of a steamer in accordance with German Patent 27 16 264 in which, therefore, the control takes place as a function of a position of the steam/air boundary layer determined by a temperature-sensor arrangement in the region of the entrance opening 3. When the steamer is full, at first little takes place, i.e., the feed valve remains substantially closed. Then the boundary layer slowly moves back upward. The feed valve is opened, but further than necessary. It overshoots the degree of opening which is present in steady state, as can be noted from the peak at 33. The steam-air boundary layer is displaced downward, as a result of which the feed valve is again closed, but again too much, so that the degree of opening undershoots the steady value, as indicated by the trough 34. There thus results a hunting action which lasts for longer than two minutes in the example shown.

In the instant invention, on the other hand, after the steamer housing 1 has been filled, which is detected by the temperature sensor 28 and corresponds to the start of the time scale, the quantity control valve 21 is opened. This takes place along the solid-line curve 35 continuously up to the steady value which results from the calculation. The quantity control valve 21 is driven by a motor and requires a certain period of time of about 20 seconds until its complete opening to the steady value. From then on, no variation about the steady-state value takes place since the amount of steam fed corresponds precisely to the amount of steam consumed and there is no longer any displacement of the steam front which would have to be compensated for by opening the feed valve to a greater or lesser extent.

While, therefore, in the other device, the control must first seek the correct degree of opening, it is immediately established in the case of the instant invention, so that such oscillations can be avoided.

What is claimed is:

1. A method of regulating the feed of steam to a steamer in a system for the treatment of liquid treated webs of material, comprising the steps of:

applying liquid to a web of material;

measuring the amount of liquid applied to the web of material;

calculating the amount of steam necessary to treat the web as it passes through the steamer in dependence upon the amount of liquid applied to the web; and supplying at least such an amount of steam to the steamer, wherein said amount of steam provides the heat required in order to heat the web of material which is laden with liquid to the desired steaming temperature.

2. A method according to claim 1, wherein a small excess amount of steam is fed to the steamer in addition to the calculated amount of steam.

3. A method according to claim 2, wherein the feeding of the calculated amount of steam and of the amount of excess steam begins only after the steamer has been filled with steam.

4. A method according to claim 1, wherein the web is treated with liquid prior to entering the steamer via a pump loaded applicator, and the output of the pump which loads the applicator device is used as a measure of the amount of liquid applied.

5. A system for the treatment with liquid and steam of a continuously advancing web of textile material, comprising:

at least one applicator for applying liquids to the web of material;

a steamer including a housing;

a quantity control valve for feeding steam into the inside of the steamer housing; and a control device, wherein the control device controls the position of the quantity control valve so that the flow rate of steam into the steamer is proportional to the total amount of liquid applied per length of web of material by the at least one applicator.

6. A system according to claim 5, further comprising a metering pump for loading the applicator, wherein the control device responsively adjusts the position of the quantity control valve in dependence upon the output of the metering pump.

7. A system according to claim 6, further comprising:

a downward-directed opening of the steamer housing in the region of the bottom of the steamer housing;

an overflow edge formed above the bottom of the steamer housing; and a steam feed device, wherein by means of the steam feed device, a small excess amount of steam can be provided to the steamer which, in conditions of steady-state operation of the steamer, discharges over the overflow edge formed above the bottom of the steamer housing.

8. A system according to claim 5, comprising a high-moisture measuring instrument arranged in front of the entrance to the steamer for the determination of the total amount of liquid applied to the web.

9. A system according to claim 8, further comprising:

a downward-directed opening of the steamer housing in the region of the bottom of the steamer housing;

an overflow edge formed above the bottom of the steamer housing; and a steam feed device, wherein by means of the steam feed device, a small excess amount of steam can be provided to the steamer which, in conditions of steady-state operation of the steamer, discharges over the overflow edge formed above the bottom of the steamer housing.

10. A system according to claim 5, further comprising:

a downward-directed opening of the steamer housing in the region of the bottom of the steamer housing;

an overflow edge formed above the bottom of the steamer housing; and a steam feed device, wherein by means of the steam feed device, a small excess amount of steam can be provided to the steamer which, in conditions of steady-state operation of the steamer, discharges over the overflow edge formed above the bottom of the steamer housing.

11. A system according to claim 10, wherein the steam discharges at the overflow edge through an overflow opening into a vertical flow channel which is formed on the outside of the steamer housing.

12. A system according to claim 11, further including a temperature sensor for determining the extent to which the steamer housing has been filled with steam, said temperature sensor being arranged in the discharge region of the excess steam.

13. A system according to claim 12, wherein the temperature sensor is connected to the control device and by means of said device the quantity control valve is opened in dependence upon a signal of the temperature sensor indicating steam temperature.

14. A system according to claim 10, further including a temperature sensor for determining the extent to which the steamer housing has been filled with steam, said temperature sensor being arranged in the discharge region of the excess steam.

15. A system according to claim 14, wherein the temperature sensor is connected to the control device and by means of said device the quantity control valve is opened in dependence upon a signal of the temperature sensor indicating steam temperature.

* * * * *